US007504009B2

(12) United States Patent
Osara et al.

(10) Patent No.: US 7,504,009 B2
(45) Date of Patent: Mar. 17, 2009

(54) METHOD FOR THE FORMATION OF A GOOD CONTACT SURFACE ON AN ALUMINIUM SUPPORT BAR AND A SUPPORT BAR

(75) Inventors: Karri Osara, Peräläntie (FI); Veikko Polvi, Huvisuulintie (FI)

(73) Assignee: Outotec Oyj, Espoo (FI)

( * ) Notice: Subject to any disclaimer, the term of this patent is extended or adjusted under 35 U.S.C. 154(b) by 477 days.

(21) Appl. No.: 10/533,798

(22) PCT Filed: Nov. 6, 2003

(86) PCT No.: PCT/FI03/00829

§ 371 (c)(1),
(2), (4) Date: May 4, 2005

(87) PCT Pub. No.: WO2004/042121

PCT Pub. Date: May 21, 2004

(65) Prior Publication Data

US 2006/0163079 A1 Jul. 27, 2006

(30) Foreign Application Priority Data

Nov. 7, 2002 (FI) ..... 20021993

(51) Int. Cl.
*C25B 9/02* (2006.01)

(52) U.S. Cl. ..... 204/279; 204/281; 204/286.1; 204/297.01; 205/602; 205/603; 205/366; 205/369; 205/191

(58) Field of Classification Search ..... 205/602, 205/603, 369, 366, 184, 191, 122; 204/278.5, 204/279, 281, 286.1, 297.01
See application file for complete search history.

(56) References Cited

U.S. PATENT DOCUMENTS

| | | | | |
|---|---|---|---|---|
| 2,790,656 | A | 4/1957 | Cook | |
| 4,015,099 | A * | 3/1977 | Seniuk et al. | 219/118 |
| 4,035,280 | A * | 7/1977 | Deane et al. | 204/267 |
| 4,043,893 | A * | 8/1977 | Gelfand | 204/281 |
| 4,246,321 | A * | 1/1981 | Shibata | 428/614 |
| 6,045,669 | A | 4/2000 | Matsumoto et al. | |
| 2002/0100694 | A1 * | 8/2002 | Morin et al. | 205/170 |
| 2006/0108230 | A1 * | 5/2006 | Osara et al. | 205/122 |

FOREIGN PATENT DOCUMENTS

| | | |
|---|---|---|
| DE | 3323516 | 8/1984 |
| EP | 0376447 | 7/1990 |
| GB | 2252569 | 8/1992 |

* cited by examiner

*Primary Examiner*—Bruce F Bell
(74) *Attorney, Agent, or Firm*—Morgan & Finnegan, L.L.P.

(57) ABSTRACT

The invention relates to a method for achieving a good contact surface on an aluminium electrode support bar used in electrolysis. In the method the support bar is fabricated as a continuous bar and a highly electroconductive layer is formed on its end. The highly electroconductive layer forms a metallic bond with the support bar and can be achieved for example with thermal spray coating. The invention also relates to an electrode support bar, the end of which is coated with a highly electroconductive material.

13 Claims, 1 Drawing Sheet

METHOD FOR THE FORMATION OF A GOOD CONTACT SURFACE ON AN ALUMINIUM SUPPORT BAR AND A SUPPORT BAR

FIELD OF THE INVENTION

This application claims the benefit of International Application No. PCT/FI2003/000829 filed on Nov. 6, 2003 under 35 U.S.C. §371, entitled, "Method For The Formation Of A Good Contact Surface On An Aluminum Support Bar And A Support Bar" which claims the benefit of Finnish Patent Application No. 20021993, filed on Nov. 7, 2002.

The invention relates to a method for achieving a good contact surface on an aluminium electrode support bar used in electrolysis. In the method the support bar is fabricated as a continuous bar and a highly electroconductive layer is formed on its end. The highly electroconductive layer forms a metallic bond with the support bar and can be achieved for example with thermal spray coating. The invention also relates to an electrode support bar, the end of which is coated with a highly electroconductive material.

BACKGROUND OF THE INVENTION

In electrolysis nowadays, particularly in zinc electrolysis, cathode plates made of aluminium are used, which are connected to support bars. The cathode is lowered into the electrolysis cell by the support bars so that one end of the support bars is located on top of the busbar at the edges of the cell and the other end on top of the insulation. To ensure good electrical conductivity, a contact piece made of copper is attached to the ends of the aluminium support bar, and the contact piece is set on top of the busbar. The lower edge of the contact piece is either horizontal or a notch is made there and the support bar is lowered on top of the busbar at the notch. Both side edges of the notch form a linear contact, creating a double contact between the support bar and the busbar. When the lower edge of the contact piece is straight, an plane-type contact is formed between the busbar and contact piece. A contact piece of this kind is used particularly in large cathodes, known as jumbo cathodes.

The copper contact piece can be attached to the aluminium support bar for example by various welding methods. One of these methods is described for instance in U.S. Pat. No. 4,035,280. The Japanese application 55-89494 describes another method of manufacturing an electrode support bar. The actual support bar is aluminium and to its end is welded a contact piece with an aluminium core and a copper shell. The contact pieces are given their polygonal form using high-pressure extrusion.

When copper is joined to aluminium, brittle and poorly conductive phases, such as $Al_2Cu$, AlCu, $Al_3Cu_4$, $Al_2Cu_3$ and $AlCu_3$, can easily be formed on the interface. These phases contain non-metallic covalent bonds and it is these that give rise to their great electrical resistance. Generation of these phases is possible for instance during fusion welding. Diffusion-based jointing methods may also cause the generation of the above-mentioned phases.

The tendency of aluminium to form a passivation layer on its surface i.e. a thin oxide film, in the presence of air or moisture, is a great hindrance to the joining of aluminium to other materials e.g. using soldering methods, and also to the fabrication of aluminium-aluminium joints. This is, in fact, the greatest single problem in joining copper and aluminium to each other. The passivation layer prevents contact between the metal and the solder, and thus when using brazing technique the oxide film has to be removed before brazing. One can attempt to remove the oxide film before preparing the joint, but the oxidation reaction is very quick and in an air atmosphere the formation of oxide cannot be avoided. There are also what are termed active solders on the market, which are claimed to moisten the aluminium regardless of the oxide layer, but their alloying elements, however, are not suitable for an electrolysis environment. In addition, solders that melt at low temperatures i.e. below 250° C., have to be stripped away, because the temperature of the contact pieces may in exceptional circumstances (short circuits) rise quite high locally and this limits the use of said solders in electrolysis.

DE patent application 3323516 describes a method in which cathodes are used in zinc electrolysis, where the support bar is aluminium and the copper contact pieces are attached to it by soldering. The solder used is an aluminium/silicon-based solder.

In the research that we carried out it was found that the use of aluminium rods containing silicon in aluminium and copper welding generates Al—Si eutectic, which fare badly in the corrosive conditions of electrolysis.

As stated before, achieving a good connection between copper and aluminium is difficult. The electric current passing via the contact pieces to the cathode can nevertheless be considerable, e.g. in the range of 600-1600 A. If the joint between the actual support bar and the contact piece in the electrode support bar is poor, the current travels only locally in the joint and the current flowing through these points becomes excessively large per unit of surface area. This causes local overheating and as a result the oxidation of copper, which further worsens the flow of the current to the cathode.

U.S. Pat. No. 4,035,280 also mentions that copper contact pieces can be coated with silver before welding. It is clear that a silvered contact piece conducts electricity well, but if the welding joint between the aluminium support bar and the contact pieces remains poor, that is a more decisive factor on the whole than the use of silver in the contact pieces.

BRIEF SUMMARY OF THE INVENTION

According to the present invention a method has now been developed, whereby the support bar of an electrode used in electrolysis is formed of a continuous aluminium bar, on at least one end of which a highly electroconductive coating is formed instead of attaching a separate contact piece to it. The electrode is composed of an electrode plate and support bar, whereby the plate section is immersed in the electrolysis cell and the support bar is supported at its ends on the edges of the electrolysis cell so that the highly electroconductive end is held on the cell busbar. According to the method now developed, the underside of the support bar, the contact surface, which will come into contact with the electrolysis cell busbar, is coated with a highly electroconductive metal or metal alloy. A particularly good electroconductive contact surface is achieved by coating the underside of the end of the support bar with silver. Silver-copper or copper coating may also be used. An alternative is to form first a copper layer and then onto it a silver or silver alloy coating with a transmission layer. When a metallic joint is formed between the aluminium support bar and the coating made on its surface, the problems mentioned above caused by the joint of the support bar and contact piece are avoided.

Figure 1:
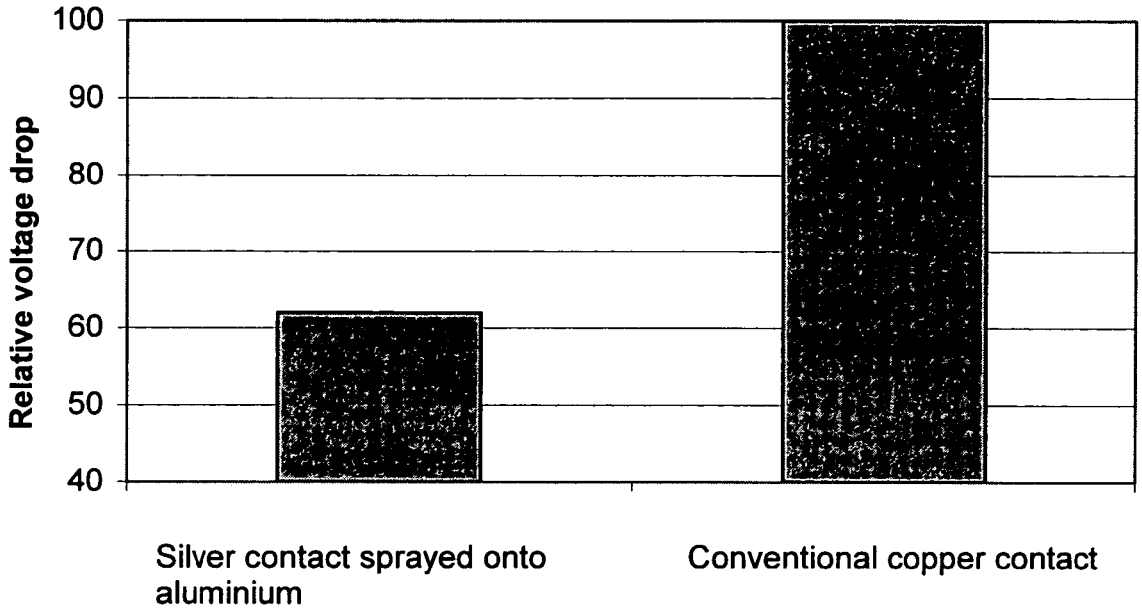
FIG. 1 shows the relative voltage drop of the contact surfaces.

The features presented in the claims are characteristic of the invention.

DETAILED DESCRIPTION OF THE INVENTION

When we refer in the text for the sake of simplicity to the coating of the end of the support bar, it means that the coating is made chiefly on the lower side of the support bar end, which is placed on top of the electrolysis cell busbar and which thus acts as the contact surface. The contact surface may be essentially horizontal or notched. Both ends of the support bar may be coated if necessary.

The term support bar in the description of the invention also refers to a support bar with a core of aluminium and a casing of some other material on top, such as refined steel, titanium or lead. The casing of the support bar is removed from at least one end of the bar and the aluminium core is used as the contact surface, which is coated.

A good contact between the aluminium and the coating material is achieved in particular with thermal spraying coating methods or by combining it with soldering. Thermal spraying technique breaks the passivation layer of the aluminium so that the contact of the metals is good enough to give rise to the formation of a metallurgical joint, which ensures that the coating adheres to the substrate. The invention also relates to an electrode support bar used in electrolysis, that is manufactured according to the method, and of which at least one end is coated with a highly electroconductive material.

The coating of the end of an aluminium support bar is justifiable on many reasons. It has already been presented above that good electrical conductivity is ensured not by manufacturing a separate contact piece to conduct current to the cathode but by using the support bar itself for this purpose. The use of a highly electroconductive metal such as copper or in particular silver or both as coating material ensures an effective feed of current to the cathode. The metallurgical principle for the use of silver is that although it forms oxides on the surface, even at relatively low temperatures the oxides are no longer stable and decompose back to the metallic form. For the above reason oxide films do not form on silver coating made by thermal spraying technique in the same way as they do for example on a copper surface.

The use of silver is also justified in coating by thermal spraying technique is because the melting point of silver is 960° C. i.e. much lower than that of copper (1083° C.). The melting point of a eutectic Ag—Cu alloy such as alloy wire or powder is even lower than that of silver and is also suitable for support bar coating. Nevertheless, copper can also be used as coating material for a support bar, because the electrical conductivity of pure copper is somewhat higher than that of aluminium. Copper and silver behave analogously as a conductive coating, the difference lies mainly in their oxidation behaviour. The drawback of copper is that the oxide layer that is generated worsens the electrical conductivity and in a sulphuric acid environment copper oxides speed up the corrosion of the contact point.

The support bar can be coated by thermal spray technique either directly with silver or a copper coating can be made first on top of the aluminium and the silver coating made on top of that. An alloy of AgCu may be used as coating material, for example in wire or powder form. If the bar is first coated with copper and after that with silver, using of a transmission layer is necessary. In this case, the coating can also be performed by combining thermal spray technique and soldering.

Silver does not form a metallurgical, good adhesive joint directly on top of copper, so instead a thin transmission layer has to be formed on the copper first, preferably one of tin or a tin-dominant alloy. Hereafter in the text for the sake of simplicity we shall refer only to tin, but the term also covers tin-dominant alloys. A tin layer can be formed in many ways as by beforehand tin plating through heating, electrolytic coating or by thermal spraying directly on the surface point before the actual coating. After this, the tin surface can be coated with silver or silver alloy. The coating with silver of the copper contact surface of the support bar can be carried out advantageously for instance with thermal spraying or soldering technique.

In zinc electrolysis, for instance, periodic maintenance of cathodes is performed, when the condition of the cathode is checked. The cathode plate wears faster than the support bar and thus one bar also outlasts several cathode plates in the prior art. The service life of a support bar can however be extended according to this method in a simple way, in that the coating of the end of the bar can be renewed as required.

Of the thermal spraying techniques available, in practice at least techniques based on gas combustion have proved practicable. Of these, High Velocity Oxy-Fuel (HVOF) spraying is based on the continuous combustion at high pressure of fuel gas or liquid and oxygen occurring in the combustion chamber of the spray gun and the generation of a fast gas flow with the spray gun. The coating material is fed into the gun nozzle most often axially in powder form using a carrier gas. The powder particles heat up in the nozzle and attain a very high kinetic speed (several hundreds of metres per second) and they are directed at the piece to be coated.

In ordinary flame spraying, as the mixture of fuel gas and oxygen burns it melts the coating material, which is in wire or powder form. Acetylene is generally used as fuel gas due to its extremely hot flame. The coating material wire is fed through the wire nozzle with a feed device using a compressed air turbine or electric motor. The gas flame burning in front of the wire nozzle melts the end of the wire and the melt is blown using compressed air as a metallic mist onto the piece to be coated. The particle speed is in the range of 100 m/s.

Before coating the support bar the bar is cleaned of the oxide layer and other residue, for example by sandblasting or wire brushing. In research it has been found that although the surface of the aluminium bar has time to to oxidize to some extent before coating, spraying technique enables the coating to form a good tight contact with the aluminium bar. When the cleaning and coating of the bar are carried out as consecutive procedures, the passivation layer typical of aluminium does not form diffusion barriers, and the coating can be made to stick tightly to its substrate.

Thermal spraying technique melts the surface material and since the molten droplets of the silver-bearing coating have a high temperature, a metallurgical bond is generated between the aluminium and coating material in the coating of the support bar. Thus the electrical conductivity of the joint is good. The metal joining method utilizes the eutectic reactions between silver and aluminium, copper and aluminium or silver, copper and aluminium, whereby eutectic is formed in the joint area.

When soldering technique is used to form a silver coating onto the copper surface, the surface to be treated is cleaned and a tin layer is formed on it, preferably less than 50 μm thick. Then the silver coating is carried out with some suitable burner. The tin layer melts and when the coating silver sheet is placed on top of the molten tin, it is easy to position in the correct place.

A short period of heat treatment can be performed on the support bar after coating if necessary. This ensures the formation of eutectic in the joint area of the support bar and coating, further strengthening the joint. Mechanical pressing can be added to the heat treatment if required.

The invention also relates to the support bar of an electrode used in electrolysis, which is fabricated at least partially from aluminium. The support bar is continuous and at least one end is coated with a highly electroconductive metal such as silver, copper or a combination of both. Coating is preferably performed using thermal spraying technique or by combining thermal spraying technique and soldering, whereby a metallurgical joint is generated between the support bar and coating. The joint area can be painted if required.

The method of the invention is described further using the following example and the appended FIG. 1, which shows the relative voltage drop of the support bars according to the invention, and a conventional support bar equipped with a copper contact piece.

EXAMPLE

Zinc electrowinning cells contained 49 production-scale electrodes. The cell busbars were conventional copper bars. The cathode support bars were made of aluminium according to the invention and their contact surface, which touched the busbar, was coated with silver. The reference cathode support bars were manufactured conventionally by attaching a copper contact piece to the end of the aluminium bar. The test results presented in FIG. 1 are the average results from a two-month monitoring period. The voltage drop of the conventional support bar is shown with a value of 100 and the voltage drop of the cathodes according to the invention is shown in relation to this.

The invention claimed is:

1. A support bar for an electrode used in electrolysis, wherein a plate section of the electrode is immersible in an electrolysis cell and the support bar is supportable by its ends on the edges of the electrolysis cell, wherein the area on the lower surface of the end of the aluminium support bar, the contact surface, comprises a highly electroconductive coating layer of silver or silver alloy and wherein said highly electroconductive coating layer forms a metallurgical bond with the aluminium support bar.

2. The support bar according to claim 1, wherein the silver alloy is silver-copper.

3. The support bar according to claim 1, wherein the support bar is equipped with a casing section made of some other material.

4. The support bar according to claim 1, wherein the highly electroconductive coating layer of silver or silver alloy is formed using thermal spraying technique.

5. A method for the formation of a contact surface having good electrical conductivity on an aluminium support bar of an electrode used in electrolysis, comprising forming a highly electroconductive layer on at least one end of the aluminum support bar by coating the lower surface of the at least one end of the aluminum support bar with silver or a silver alloy using a thermal spraying technique, wherein a metallurgical bond is formed between the aluminium support bar and highly electroconductive coating material, and wherein the aluminium support bar is for immersing an electrode plate in an electrolysis cell and for supporting a plate support bar by its ends on the edges of the electrolysis cell so that the highly electroconductive end is held on a busbar.

6. The method according to claim 5, wherein the silver alloy is silver-copper.

7. The method according to claim 5, wherein the support bar is equipped with a casing section made of some other material.

8. The method according to claim 5, wherein the thermal spraying technique is based on gas combustion.

9. The method according to claim 5, wherein the thermal spraying technique is high velocity oxy-fuel spraying.

10. The method according to claim 5, wherein the highly electroconductive coating material is in powder form.

11. The method according to claim 5, wherein the thermal spraying technique is flame spraying.

12. The method according to claim 5, wherein the highly electroconductive coating material is in wire form.

13. The method according to claim 5, wherein the at least one end of the aluminium support bar is furnished on the lower surface with a notch, and wherein the notch area is coated with the highly electroconductive material.

* * * * *

UNITED STATES PATENT AND TRADEMARK OFFICE

CERTIFICATE OF CORRECTION

PATENT NO. : 7,504,009 B2
APPLICATION NO. : 10/533798
DATED : March 17, 2009
INVENTOR(S) : Osara et al.

It is certified that error appears in the above-identified patent and that said Letters Patent is hereby corrected as shown below:

On the Title Page

Item [*] Notice: Subject to any disclaimer, the term of this patent is extended or adjusted under 35 USC 154(b) by 477 days Delete the phrase "by 477 days" and insert -- by 599 days --

Signed and Sealed this

Thirteenth Day of April, 2010

David J. Kappos

David J. Kappos
*Director of the United States Patent and Trademark Office*